US009088060B2

(12) United States Patent
Robin et al.

(10) Patent No.: US 9,088,060 B2
(45) Date of Patent: Jul. 21, 2015

(54) MICROWAVE TRANSITION DEVICE BETWEEN A STRIP LINE AND A RECTANGULAR WAVEGUIDE WHERE A METALLIC LINK BRIDGES THE WAVEGUIDE AND A MODE CONVERTER

(75) Inventors: Michel Robin, Marly-le-Roi (FR); Guillaume Tolleron, Les Clayes sous Bois (FR)

(73) Assignee: AIRBUS DS SAS, Elancourt (FR)

( * ) Notice: Subject to any disclaimer, the term of this patent is extended or adjusted under 35 U.S.C. 154(b) by 187 days.

(21) Appl. No.: 13/513,626

(22) PCT Filed: Dec. 6, 2010

(86) PCT No.: PCT/EP2010/069007

§ 371 (c)(1), (2), (4) Date: Jun. 4, 2012

(87) PCT Pub. No.: WO2011/069980

PCT Pub. Date: Jun. 16, 2011

(65) Prior Publication Data

US 2012/0242421 A1 Sep. 27, 2012

(30) Foreign Application Priority Data

Dec. 7, 2009 (FR) ..... 09 58684

(51) Int. Cl.
*H01P 5/107* (2006.01)

(52) U.S. Cl.
CPC ..... *H01P 5/107* (2013.01); *Y10T 29/4913* (2015.01)

(58) Field of Classification Search
CPC ..... H01P 5/107
USPC ..... 333/26, 34
See application file for complete search history.

(56) References Cited

U.S. PATENT DOCUMENTS

| | | | | |
|---|---|---|---|---|
| 4,636,753 | A | 1/1987 | Geller et al. | |
| 5,184,095 | A * | 2/1993 | Hanz et al. | 333/33 |
| 5,262,739 | A * | 11/1993 | Dalman | 333/26 |
| 6,927,477 | B2 * | 8/2005 | Araya | 257/662 |
| 7,109,820 | B1 * | 9/2006 | Lucas et al. | 333/26 |
| 2010/0001808 | A1 * | 1/2010 | Lee et al. | 333/26 |

FOREIGN PATENT DOCUMENTS

| | | |
|---|---|---|
| JP | 61142802 | 6/1986 |
| WO | WO2008060047 | 5/2008 |

OTHER PUBLICATIONS

Dominic Deslandes and Ke Wu, "Integrated Microstrip and Rectangular Wavegulde in Planar Form"; IEEE Microwave and Wireless Components Letters, vol. 11, No. 2, Feb. 2001.

* cited by examiner

*Primary Examiner* — Benny Lee
(74) *Attorney, Agent, or Firm* — Jerold I. Schneider; Schneider Rothman IP Law Group PLLC

(57) ABSTRACT

For associating different technologies of a microstrip line and of a rectangular waveguide, for example on a ceramic, in a transition device including a mode transformer between the line integrated into a printed circuit board, and the waveguide, the board includes a housing containing the waveguide with a large sidewall coplanar and coaxial to the strip of the line and another large sidewall fixed onto a metallic layer of the board at the bottom of the housing. A linking metallic element bridges a mechanical tolerance gap between the transformer and one of the line and the waveguide. The transformer can be integrated into the board, or into the waveguide in a microwave component.

10 Claims, 5 Drawing Sheets

MICROWAVE TRANSITION DEVICE BETWEEN A STRIP LINE AND A RECTANGULAR WAVEGUIDE WHERE A METALLIC LINK BRIDGES THE WAVEGUIDE AND A MODE CONVERTER

CROSS-REFERENCE TO RELATED APPLICATIONS

This application is the entry into the United States of PCT Application No. PCT/EP2010/069007 filed Dec. 6, 2010 and claims priority from French Patent Application Number FR 0958684 filed Dec. 7, 2009, the entirety of each of which are hereby incorporated by reference.

BACKGROUND OF THE INVENTION

The present invention relates to passive components for microwave propagation. More particularly, it relates to a planar transition device between a conductive microstrip line and a component in rectangular waveguide technology.

The conductive microstrip technology offers the possibility to quite easily integrate microwave functions to frequencies of a few Gigahertz, including up to the C-band. Such a technology becomes more complex when used at higher frequencies, of about ten Gigahertz (Ku-band, K-band and Ka-band). Indeed, the radiating nature of a microstrip line requires conductors to be contained in a conductive mechanical structure providing an electric shielding. The dimensions of such a mechanical structure should be smaller since the frequency is high.

SUMMARY OF THE INVENTION

Air waveguides are, by nature, not radiating structures, and are poorly adapted for integrating complex functions. As a result, waveguides are used for low loss devices or for high microwave powers. Replacing air by a dielectric with a relative permittivity higher than 1, allows the dimensions of the waveguide to be sufficiently reduced so as to allow a substrate integrated waveguide to be integrated into a microstrip line.

The article "Integrated Microstrip and Rectangular Waveguide in Planar Form" by Dominic Deslandes and Ke Wu, IEEE MICROWAVE AND WIRELESS COMPONENTS LETTERS, Vol. 11, No. 2, February 2001, provides a solution to the transformation with no loss of the quasi-TEM propagation mode in the microstrip line into the electric transverse fundamental mode $TE_{10}$ of the waveguide. The transition device according to this article comprises one single thin dielectric substrate wherein there are integrated a microstrip line, a rectangular waveguide and a planar mode transformer between the line and the waveguide. The mode transformer provides, in addition to the transformation from the quasi-TEM mode into the $TE_{10}$ mode, the electric continuity between the line and the waveguide. On the face of the dielectric substrate supporting the strip of the line, the mode transformer comprises an isosceles trapezoid tapered conductive section having a small base merging into an end of the strip and a larger base merging into a central portion of the cross sectional edge of a first large sidewall of the waveguide. The other face of the dielectric substrate is fully covered with a conductive layer acting as a ground plane for the line and as a second large sidewall for the waveguide. The small longitudinal sidewalls of the waveguide are made either by two rows of metallized through holes or by two metallized grooves arranged in the dielectric substrate. Thus, the height (or the thickness) of the waveguide can be reduced with little influence on the propagation of the TE10 mode, allowing the waveguide to be integrated into the thin dielectric substrate of the microstrip line while reducing losses through radiation.

The structure of the transition device in the abovementioned article is used in European patent 1 376 746 81 for integrating a microwave filter in rectangular waveguide and a microstrip line on the same thin dielectric substrate.

An object of the invention is to associate, by means of a microwave transition device, a first technology of a microstrip line with a second technology of a waveguide different from the first one, while maintaining the advantages both of those technologies.

Accordingly, a transition device comprising a mode transformer between a conductive strip line integrated into a printed circuit board, and a rectangular waveguide, is characterized in that the board comprises a housing containing the waveguide having a large sidewall coplanar and coaxial to the strip of the line and another large sidewall fixed onto a metallic layer of the board at the bottom of the housing, and the device comprises a gap bridged by a metallic linking element and located between the mode transformer and one of the line and the waveguide.

The mode transformer is integrated into the dielectric substrate either of the board according to the first technology or of the waveguide according to the second technology. If the mode transformer is integrated into the dielectric substrate of the board, the gap and the metallic linking element are located between the mode transformer and an end of the waveguide. If the mode transformer is integrated into the dielectric substrate of the waveguide, the gap and the metallic linking element are located between an end of the strip line and the mode transformer. The gap results from a mechanical tolerance for introducing the structure of the waveguide into the housing of the board. The metallic linking element which can comprise one or more metallic sheet strips or one or more metallic wires, provides the electric continuity between the strip of the line and a large sidewall of the waveguide via the mode transformer that matches the impedances of the strip of the line and the larger sidewall of the waveguide while taking into consideration the mismatch created by the gap bridged by the linking element. The impedances are matched in the mode transformer by strip line segments having strip widths and thicknesses, i.e. the distances between the microstrip line and the ground plane, that increase by steps from the strip line to the waveguide, and having lengths approximately equal to one quarter of wavelength.

Whatever the embodiment of the transition device, the microstrip line technology, like that of a multilayer printed circuit board, and the manufacturing technology for the waveguide, like Substrate Integrated Waveguide (SIW) technology on a ceramic substrate, are maintained, imparting more flexibility in the choice of the characteristics of the line and the waveguide, more specifically the different dielectric relative permittivities of the board and the waveguide. In particular, the waveguide can be integrated into a microwave component having a ceramic substrate; the small sidewalls of the waveguide can each be constituted by rows of staggered metallized holes for reducing the losses through radiation.

This invention achieves low radiation, low loss and low weight microwave structures, while suppressing a large part of the metallic structure and is thus particularly valuable for airborne devices. It enables the association of a microstrip line with various rectangular waveguide structures, including very selective filters and couplers with high directivity. In particular, this invention is appropriate for implementing emitting or receiving heads, or network or electronic scanning antennas, operating at high frequencies up to about ten Gigahertz.

This invention also relates to a method for manufacturing a transition device comprising a mode transformer between a strip line integrated into a printed circuit board, and a rectangular waveguide. The method is characterized by the following steps:

arranging in the board a housing having a bottom consisting in a portion of a metallic layer internal to the board, introducing the waveguide inside the housing so that a large sidewall of the waveguide be coplanar and coaxial to the line strip and another large sidewall of the waveguide be fixed onto the portion of the metallic layer, and forming and fixing a thin metallic linking element bridging a gap between the mode transformer and one of the line and the waveguide.

BRIEF DESCRIPTION OF THE DRAWINGS

Other characteristics and advantages of the present invention will become more clearly apparent from reading the following description of several embodiments of the invention, given by way of non-limiting examples, with reference to the corresponding appended drawings in which:

FIG. 7, comprising

DETAILED DESCRIPTION OF PREFERRED EMBODIMENTS

According to an embodiment of the invention shown in FIGS. 1 to 4, a transition device is a passive microwave circuit between a microstrip line 1 integrated into a thin printed circuit board 2 of the multilayer PCB ("Printed Circuit Board") type and a microwave component 3 with a rectangular waveguide structure between which a planar mode transformer 4 is arranged. In these figures, two transition devices symmetrical about the transversal plane of the microwave component 3 are arranged at the longitudinal ends of the component on the same board 2. The component 3 is to be fitted on the board 2 for being adapted, to the size and propagation characteristics of the microstrip line 1. The board 2 integrating the microstrip line 1 thus acts as a support for the component 3.

Figure 1:
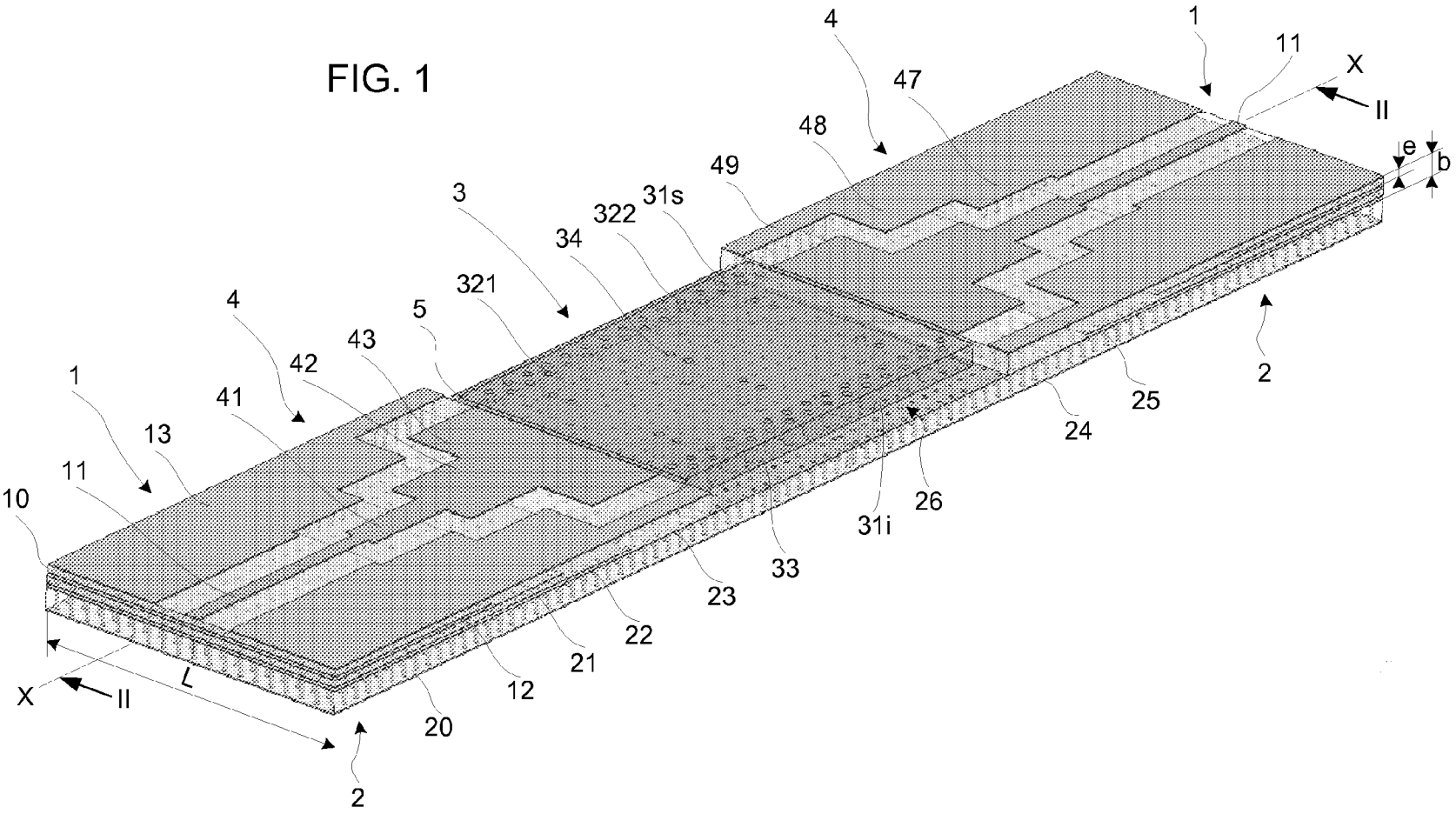
FIG. 1 is a top perspective view of two transition devices according to the invention.

The printed circuit board 2 is a microwave circuit and has a transverse section with a smaller thickness E (FIG. 4) compared to its width L (FIG. 1). The board comprises layers of dielectric substrate 20 between which internal metallic layers superimposed on a first face of the board. The internal metallic layers are a ground layer 12 for the line 1 and ground layers 21, 22 and 23 under the layer 12 for the mode transformers 4, as further described. The metallic layers 12, 21 and 22 extend the whole width L of the board and to a depth b (FIG. 1) of the board equal to the height of the component 3. The layer 23 located at the depth b and another metallic ground layer 24 arranged on a second face of the board 2 are separated by a layer of the substrate 20 with a thickness E-b (FIG. 1) and extend on the whole length and the whole width of the board. The layers 23 and 24 make up ground planes common to all the components supported by the board. The various layers 12 and 21, 22, 23 and 24 are connected therebetween by small metallized holes 25 perpendicular to the faces of the board.

As shown in FIGS. 1, 2, 3 and 5, the line 1 comprises a layer 10 of the substrate 20, a rectilinear metallic strip 11 on the layer 10 at the level of the first face of the board and along the longitudinal axis X-X of the board, (FIG. 1) and a ground plane formed by the internal metallic layer 12 underlying the portion of the first face of the board supporting the strip 11.

Between the metallic layers 23 and 24 of the board, other microwave devices (not shown) can be provided.

The substrate 20 is a dielectric with a low relative permittivity $\in_{r2}$. The width w of the strip 11 (FIG. 4) and the thickness e of the line, for example, of approximately E/12, are small, with respect to the width L of the board and the ground plane 12, (FIG. 1) so that the microstrip line 1 is able to propagate a wave guided in the quasi-TEM mode in the range of centimetric waves, including for high frequencies from a few Gigahertz to about forty Gigahertz so as to cover, for example, all or part of the frequency of the Ku-, K- and Ka-bands. A large part of the power is propagated in the dielectric and a small part is propagated in air in the vicinity of the conductive strip 11. The characteristic impedance $Z1_c$ of the microstrip line, typically of 50Ω, essentially depends on the width w of the strip and on the thickness e and the permittivity $\in_{r2}$ of the selected dielectric substrate 20.

Figure 2:
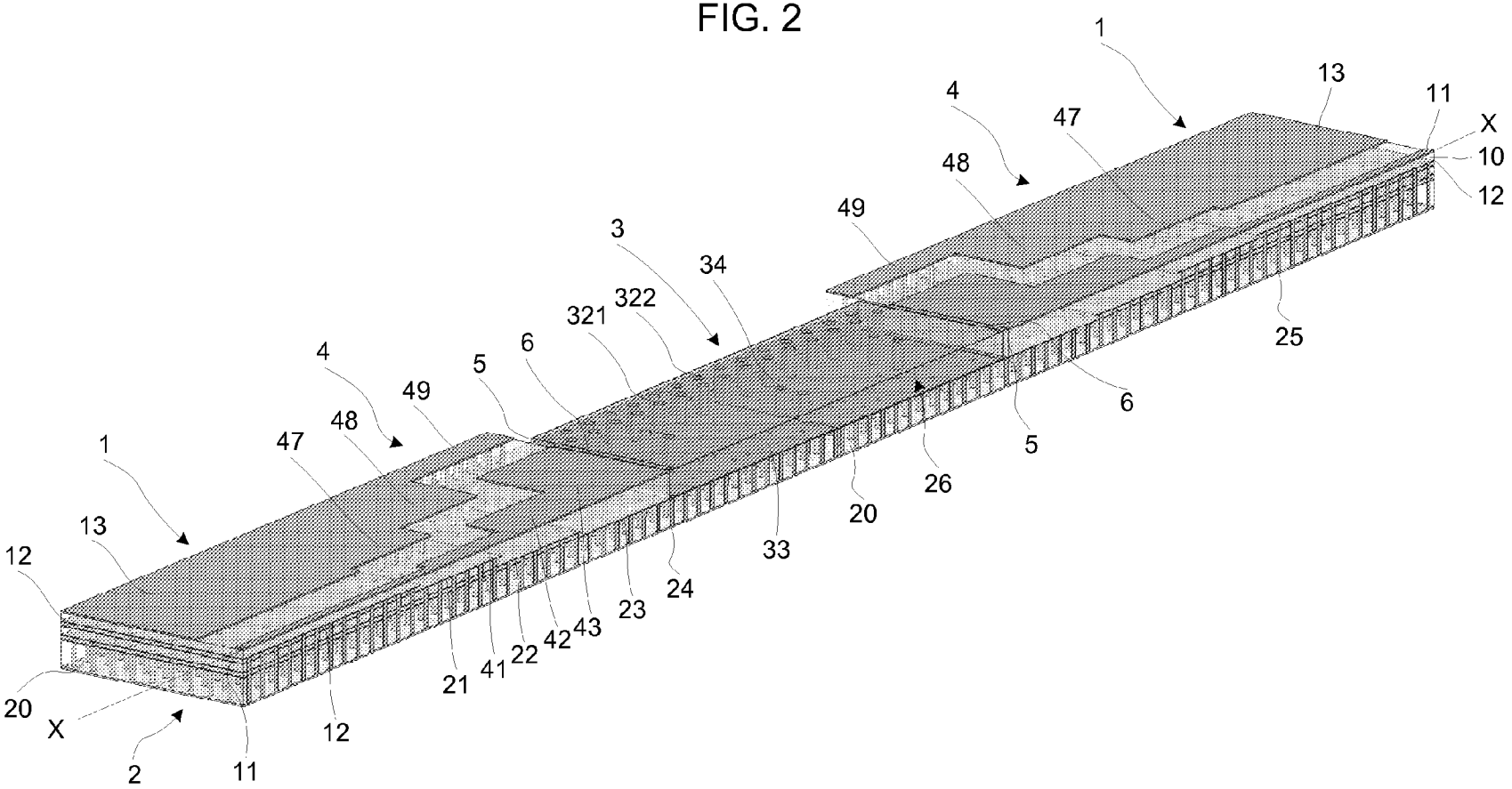
FIG. 2 is a perspective and axial longitudinal sectional view, taken along line 11-11 of FIG. 1.
Figure 3:
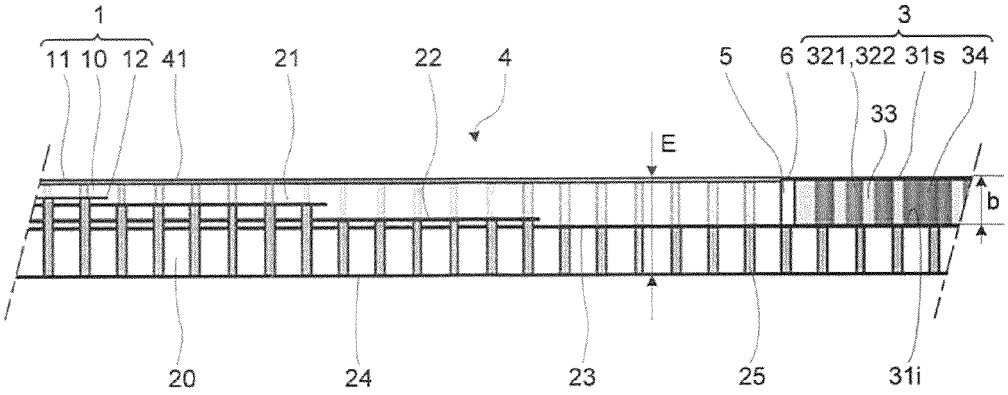
FIG. 3 is a longitudinal sectional view of the transition device at the level of a mode transformer of a transition device.
Figure 5:
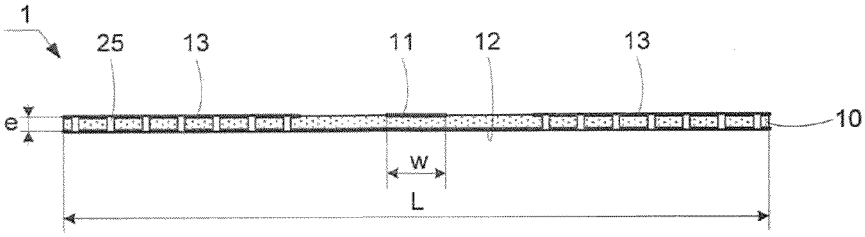
FIG. 5 is a cross sectional view of a microstrip line of the transition device.

As shown in FIGS. 1, 2 and 5, on both sides of the conductive strip 11, the line 1 is shielded by two metallic layers 13 extending symmetrically about the axis X-X, coplanar to the strip 11 on the first face of the board 2 and extending in parallel to the strip 11 at a predetermined distance of a few widths w of the strip 11 for confining the electric field lines toward the strip. The shielding layers 13 are connected to the ground layers 12 and 21, 22, 23 and 24 by metallized holes 25.

The passive microwave component 3 is manufactured according to a Substrate Integrated Waveguide (SIW) technology with a waveguide 31 integrated into a dielectric substrate 33 with a rectangular section. As shown in FIGS. 1, 2, 3, 4 and 6, the rectangular section of the waveguide comprises large sidewalls formed by two longitudinal metallic layers 31*s* and 31*i* (FIG. 3) on the large faces of the substrate 33 and small sidewalls formed by two pairs of peripheral longitudinal rows of staggered metallized holes 321 and 322 crossing the substrate 33. The pairs of hole rows 321 and 322 are symmetrical about the longitudinal axial plane of the component 3. The distance between two neighboring holes 321, 322 in each row is substantially equal to the diameter of the holes and significantly less than the operating wavelength of the waveguide so as to minimize any loss through radiation. The width a (FIG. 6) of the waveguide is defined by the distance between the pairs of rows of metallized holes 321-322 depending on the dimensions of the holes and on the pitch between the holes. The height b (FIGS. 4, 6) of the waveguide in the direction of the thickness E of the board 2 is defined by the distance between the metallic layers 31*s* and 31*i*. Alternatively, the waveguide 31 is replaced by a conventional waveguide 31 with a rectangular section having solid metallic sidewalls and filled with the dielectric substrate 33. The SIW manufacturing technology of the component 3 uses in the shown embodiment a Low Temperature Cofired Ceramic (LTCC) method, wherein the dielectric substrate 33 is a ceramic with a relative permittivity $\in_{r2}$ higher than the relative permittivity $\in_{r2}$ of the dielectric substrate 20 in the board 2 and therefore, higher than that of the layer of substrate 10 in the microstrip line 1.

In other variants of the transition device, the dielectrics of the substrate 20 of the board 2 and the substrate of the line 1 and of the substrate 33 of the waveguide 31 can be of the same nature and have an identical relative permittivities $\in_{r2}$ and $\in_{r3}$.

In order to avoid propagation discontinuities and to facilitate the change of the quasi-TEM mode of the microstrip line to the $TE_{10}$ mode of the waveguide, the height b (FIG. 4) thereof is selected to be equal to the available thickness in the board 2. To this end, a parallelepiped housing 26 is arranged in the board 2 in which is inserted, with a transversal play, the waveguide component 3 between the ends of the mode transformers 4. The height of the housing 26 is equal to the height b (FIG. 4) of the waveguide and to the thickness between the metallic strip 11 of the microstrip line 1 and the internal metallic layer 23. The external face of the large sidewall of the waveguide formed by the metallic layer 31*s* is coplanar to the strip 11 of the line 1, and the external face of the other large sidewall of the waveguide formed by the metallic layer 31*i* is in mechanical and electric contact with the portion of the metallic layer 23 at the bottom of the housing. The portion of the board underlying the housing 26 with a thickness E-b (FIG. 4) between the metallic layers 23 and 24 is maintained for optionally integrating therein one or more microwave devices. The length of the housing 26 is substantially greater than the length of the waveguide 31 and of the component 3 so as to facilitate arranging it with a mechanical tolerance play. The width of the housing 26 can be equal to the width L (FIG. 1) of the board for easily machining the board. The width of the component 3 more than the width a of the waveguide 31 is generally at the most equal to the length L of the board 2 and is determined as a function of the cutoff frequency of the $TE_{10}$ mode in the waveguide which is a function of 2*a*. For example, the ratio a/b is approximately 10 to 15 and the waveguide is thus flat. The component 3 with the waveguide 31 is centered in the housing 26 and fixed by brazing the metallic layer 31*i* on the portion of the metallic layer 23 at the bottom of the housing 26 while carefully aligning the symmetry longitudinal axial plane of the waveguide with the longitudinal symmetry axis X-X of the strip 11 of the line 1.

According to the illustrated embodiment, the passive microwave component 3 with a rectangular waveguide planar structure 31 is a bandpass microwave filter comprising six pairs of metallized holes 34 (FIGS. 1, 4) crossing the dielectric substrate 33 and connected to the metallic layers 31*s* and 31*i*. The pairs of metallized holes 34 are arranged symmetrically about the longitudinal and transverse axial planes of the component. The arrangement of the holes 34 makes up inductive pillars depending on the frequency response of the filter. According to another example, the microwave component 3 is designed as a directive coupling device.

The propagation mode transformer 4 in a transition device connects facing ends of the strip 11 of the microstrip line 1 and the large sidewall 31*s* of the waveguide 31 coplanar to the strip 11, and connects the internal ground plane layer 12 of the microstrip line to the large sidewall 31*i* of the waveguide 31 fixed to the metallic layer 23 at the bottom of the housing 26. The mode transformer 4 progressively transforms, while minimizing losses, the quasi-TEM mode of the microstrip line 1 into a $TE_{10}$ guided mode of the waveguide 31 and matches the impedances thereof. The planar structure of the mode transformer is designed so as to make up a nearly perfect quadripole, having transmission parameters $S_{12}$ and $S_{21}$ the terminals of the quadripole being approximately equal to 1 and having reflection parameters $S_{11}$ and $S_{22}$ n the terminals of the quadripole approximately equal to 0, taking into consideration, in a practical situation, losses induced by imperfect conductors and dielectrics.

Figure 6:
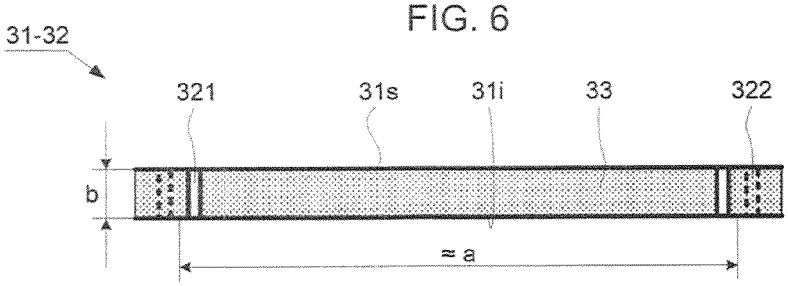
FIG. 6 is a cross sectional view of the rectangular waveguide structure of the microwave component.
Figure 4:
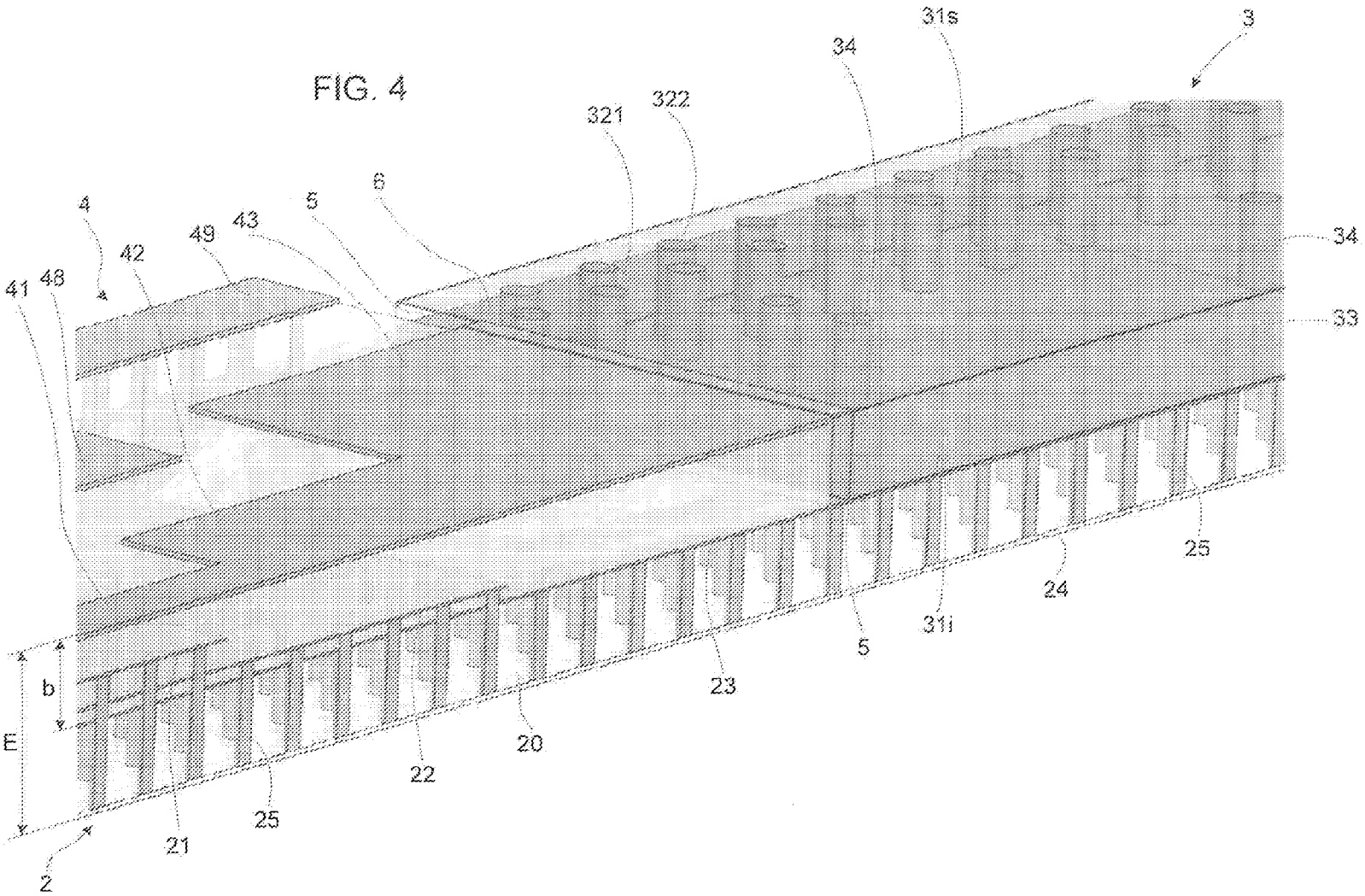
FIG. 4 is a perspective and longitudinal sectional view, similar to that on FIG. 2 and at a larger scale, at the level of a gap between the mode transformer and a passive microwave component of the transition device.

The mode transformer 4 can be integrated into the waveguide 31, or even be integrated into the board 2, as described hereinafter and shown in FIGS. 1 to 4. As the characteristic impedance of a microstrip line decreases when the ratio w/e increases, the mode transformer 4 comprises N microstrip line segments 21-41 to 2N-4N symmetrical about the longitudinal plane of the line 1 having X-X as the axis. The number N is generally at least equal to 1 and depends on the manufacturing technology based on layers of the board 2 and on that of the microwave component 3. The lengths of the segments of the mode transformer 4 are approximately equal to one quarter of the wavelength of the operating central frequency and allow for a progressive impedance transformation while minimizing interference reflections at the junctions between segments. The mode transformer 4 according to the illustrated embodiment comprises N=3 line segments 21-41, 22-42 and 2N-4N=23-43. The strip 4N=43 the closest to the component 3 has longitudinal edges substantially collinear with the longitudinal internal solid edges of the waveguide 31 delimited by the large sidewall 31*s* and the rows of metallized holes 321. As shown in detail in FIG. 4, introducing with a transverse play the component 3 in the housing 26 of the board 2 creates two air gaps 5 of several tenths of a millimeter between the longitudinal ends of the component 3, and thus of the waveguide 31, and the longitudinal ends of the line segments 2N-4N=23-43 of the mode transformers 4. For each mode transformer 4, a thin metallic linking element 6 with a length a bridges the respective gap 5 and is interposed at the level of the facing transversal edges of the strip 4N=43 and the metallic layer 31*s* of the waveguide for providing an electric continuity between such edges. The linking element 6 can be achieved by one thin metallic strip or several juxtaposed thin metallic strips, for example, being cut in a gold sheet or juxtaposed thin metallic wires 54, (FIG. 7*b*) extending parallel to the axis X-X and having the ends brazed on the strip 4N=43 and the layer 31*s* so as to cover the gap on the width a (FIGS. 4, 6). The bottom of the gap 5 is a small portion of the metallic ground layer 23 providing the electric continuity between the ground planes 12, 21, 22 and 23 of the line 1 and the line segments 21-41, 22-42 and 23-43, via the metallized holes 25, and the metallic layer 31*i* of the component 3 fixed on the underlying portion of the metallic ground layer 23. Because of the transition between the microstrip-and-dielectric-line segment and the air-and-microstrip line and the transition between the air-and-microstrip line and the waveguide at the level of the air gap 5, the lengths of the line segments are somewhat different therebetween and can be each somewhat lower than, equal to or somewhat higher than one quarter of the operating wavelength so as to compensate for interference effects including wave reflection at various transitions, in particular at the level of the gap 5, and so as to bring back by the transformer 4 an impedance equal to the characteristic impedance $Z1_c$ of the line 1, at the junction between the latter and the first line segment 21-41.

As shown in FIGS. 1 and 2, the line segments 21-41, 22-42 and 23-43 are shielded by symmetrical pairs of metallic layers 47, 48 and 49 extending the shielding layers 13. The shielding layers 47, 48 and 49 are coplanar to the strips 41, 42 and 43 on the first face of the board and extend in parallel along such strips at the predetermined distance of a few widths w (FIG. 5) of the strip 11. The shielding layers 47, 48 and 49 are connected respectively to underlying ground layers 12 and 21 to 24 by metallized holes 25.

In a second embodiment, where the mode transformer is integrated into the waveguide 31 and thus, to the component 3, the housing 26 arranged in the board is much longer. The arrangement of the line segments 21-41, 22-42 and 23-43 with the shielding layers 47, 48 and 49 and the width a (FIG. 6) of the waveguide remain. The strips 41, 42 and 43 originate from the same metallic layer as the large sidewall 31*s* of the waveguide and in electric continuity with the latter on the same face of the substrate 33 of the structure of the waveguide. The dimensions of the line segments having their metallic ground layers superimposed and integrated into the substrate 33 of the structure of the waveguide, that is then of the multilayer type, are modified as a function particularly of the relative permittivity $\in_{r3}$. The strip 4N=43 the closest to the component 3 has still the width a (FIG. 6) of the waveguide 31 and is directly linked to the transversal end of the large sidewall 31*s* of the waveguide. The air gap 5 is thereby suppressed between the line segment 23-43 and the waveguide 31 and replaced by an air gap as a result of the play required for introducing the monolithic assembly of the component with the two mode transformers in the housing of the board. The air gap is located between the end of the strip line 1 and the line segment 21-41 having the less wide strip and is bridged by a thin linking metallic element similar to the element 6, but with a width w (FIG. 5), and brazed to the strips 11 and 41.

The method for manufacturing a transition device comprises the following steps. Upon manufacturing the multilayer printed circuit board according to the illustrated embodiment, the mode transformer 4 is integrated into the board, or even in a second embodiment of this invention, the mode transformer is integrated into the waveguide structure of the component.

Then, the parallelepiped housing 26 is arranged in the board 2 at a depth equal to the height b (FIG. 3) of the rectangular waveguide 31, for example, by means of a matrix having the dimensions of the housing upon compression of the layers of the dielectric substrate 20 superimposed and coated with various metallic layers while the board is being manufactured, so that a portion of the internal ground layer 23 makes up the bottom of the housing.

The rectangular waveguide 31, or in particular the component 3 with a rectangular waveguide structure, is introduced with a longitudinal play and centered in the housing 26 so that the large sidewall 31*s* of the waveguide become coplanar and coaxial to the strip 11 of the line 1 and the other large sidewall 31*i* of the waveguide be fixed through brazing on the portion of the metallic layer 23 of the board at the bottom of the housing. The longitudinal play results from a mechanical tolerance for inserting the rectangular waveguide 31, or in particular the component 3, into the housing 26.

Then a strip or a web of several side by side strips, 52 (FIG. 7*a*) cut from a metallic sheet, or a web of several side by side metallic wires 54 (FIG. 7*b*) having a width higher than the width of the gap 5 and a thickness similar to that of the metallic layers is presented on the gap 5 so as to form the thin linking metallic element 6. The longitudinal ends of the linking metallic element are fixed on the edges of the gap 5. For the embodiment illustrated in the figures, the linking metallic element 6 bridges the gap 5 between the mode transformer 4 integrated into the board 2 and the waveguide 31, has a length equal to the width a of the waveguide, and has longitudinal ends brazed to the transversal edge of the widest strip 43 of the line segments 21-41, 22-42 and 2N-4N=23-43 of the mode transformer and to the transversal edge of the large sidewall 31*s* of the waveguide. For the second embodiment, the linking metallic element 6 bridges the gap between the microstrip line 1 and the mode transformer 4 integrated into the waveguide structure 31, has a length equal to the width w of the conductive strip 11, and has longitudinal ends brazed to the cross-sectional edge of the strip 11 and to the transversal edge of the less wide strip 41 of line segments 21-41, 22-42 and 2N-4N=23-43 of the mode transformer.

Figure 7A:
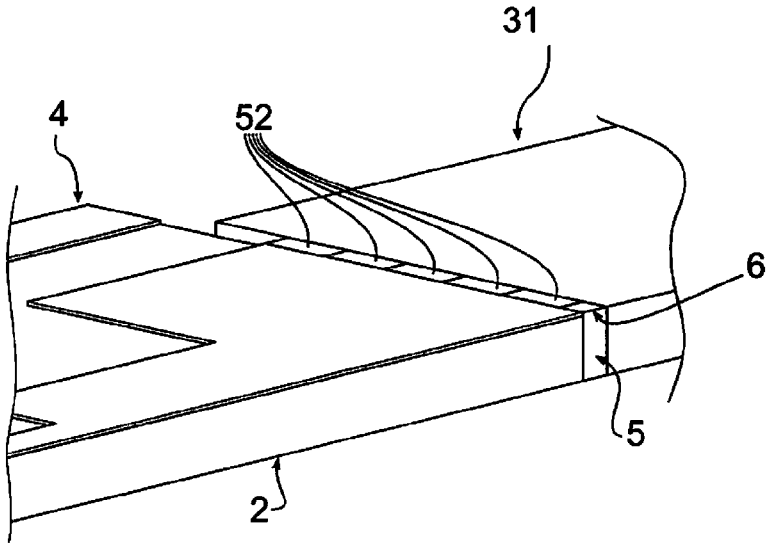
FIGS. 7*a* and 7*b*, illustrate linking metallic elements in the form of side-by-side strips (FIG. 7*a*) and side-by-side metallic wires (FIG. 7*b*).
Figure 7B:
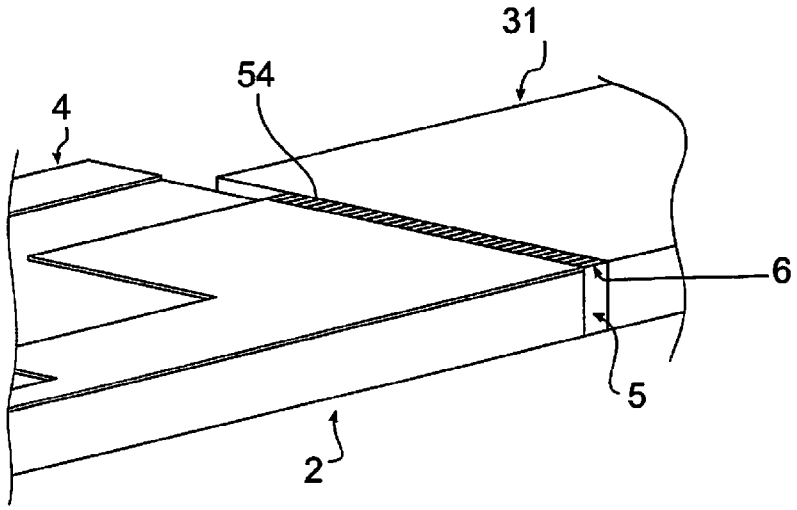

For another embodiment, shown in FIG. 7*a*, the linking metallic element 6 bridges the gap 5 between them mode transformer 4 integrated into the board 2 and the waveguide 31, and the linking metallic element 6 is formed by a web of several side-by-side strips 52. For another embodiment shown in FIG. 7*b*, the linking metallic element 6 bridges the gap 5 between the mode transformer 4 integrated into the board 2 and the waveguide 31, and the linking metallic element 6 is formed by a web of several side-by-side metallic wires 54.

The invention claimed is:

1. A transition device comprising a mode transformer between a conductive strip line integrated into a printed circuit board, and a rectangular waveguide, characterized in that the board comprises a housing containing the waveguide having a large sidewall coplanar to the strip line and another large sidewall fixed onto a portion of a metallic layer of the board at a bottom of the housing, and the device comprises a gap bridged by a linking metallic element and located between the mode transformer and the waveguide.

2. The device according to claim 1, wherein the linking metallic element comprises one or more side by side strips of metallic sheet, or several side by side metallic wires.

3. The device according to claim 1, wherein the mode transformer comprises strip line segments having strip widths and thicknesses increasing from the strip line to the waveguide and having lengths approximately equal to one quarter of wavelength.

4. The device according to claim 3, comprising shielding metallic layers extending along the strips of the strip line segments and coplanar to those strips and linked to the shielding metallic layers extending along- and coplanar to the strip of the line.

5. The device according to claim 1, wherein the permittivities of a substrate of the board and the permittivities of a substrate of the waveguide are different.

6. The device according to claim 1, wherein the waveguide is integrated into a dielectric substrate, said dielectric substrate being ceramic.

7. The device according to claim 1, wherein the waveguide includes small sidewalls each comprising rows of staggered metallized holes.

8. A method for manufacturing a transition device comprising a mode transformer between a strip line integrated into a printed circuit board, and a rectangular waveguide, characterized by the following steps: arranging in the board a housing having a bottom consisting in a portion of metallic layer internal to the board, introducing the waveguide into the housing so that a large sidewall of the waveguide be coplanar to the strip line and another large sidewall of the waveguide be fixed onto the portion of the metallic layer, and forming and fixing a thin linking metallic element bridging a gap between the mode transformer and the waveguide.

9. The method according to claim 8, comprising integrating strip line segments to the board so as to form the mode transformer, the strip line segments respectively including ground metallic layers superimposed in the board and metallic strips on a face of the board and having strip widths and thicknesses increasing from the strip line to the waveguide and lengths approximately equal to one quarter of wavelength, and fixing the linking metallic element to the widest strip of the line segments and to a large sidewall of the waveguide.

10. The method according to claim 8, comprising integrating strip line segments to the waveguide structure so as to form the mode transformer, the strip line segments respectively including ground metallic layers superimposed in the structure of the waveguide and metallic strips on a face of the structure of the waveguide and having strip widths and thicknesses increasing from the strip line to the waveguide and lengths approximately equal to one quarter of wavelength, and fixing the linking metallic element to the strip of the line and at least large strip of the line segments.

* * * * *